United States Patent [19]

Lally et al.

[11] Patent Number: 4,857,808

[45] Date of Patent: Aug. 15, 1989

[54] MODIFIED IMPEDANCE RAPID START FLUORESCENT LAMP SYSTEM

[75] Inventors: William J. Lally, Verona, N.J.; Edward W. Morton, Boston, Mass.

[73] Assignee: North American Philips Corporation, New York, N.Y.

[21] Appl. No.: 240,436

[22] Filed: Sep. 1, 1988

[51] Int. Cl.[4] ..... H05B 41/36

[52] U.S. Cl. ..... 315/100; 315/49

[58] Field of Search ..... 315/49, 73, 74, 75, 315/100, 101; 337/27

[56] References Cited

U.S. PATENT DOCUMENTS

| | | | |
|---|---|---|---|
| 2,729,769 | 1/1956 | Hamilton | 315/100 |
| 4,010,399 | 3/1977 | Bessone et al. | 315/73 |
| 4,435,670 | 3/1984 | Evans et al. | 315/58 |
| 4,501,992 | 2/1985 | Evans et al. | 315/58 |
| 4,510,418 | 4/1985 | Anderson, Jr. et al. | 315/74 |

*Primary Examiner*—Robert L. Griffin
*Assistant Examiner*—T. Salindong
*Attorney, Agent, or Firm*—Paul R. Miller

[57] ABSTRACT

A modified impedance rapid start fluorescent lamp system is provided with interrupted cathode heating. This structure includes a circuit in parallel with one of the bimetal switches at each side of a cathode. The circuit includes a current limiting capacitor and bleeder resistor connected in parallel with each other and a third normally closed thermal bimetal switch.

10 Claims, 2 Drawing Sheets

MODIFIED IMPEDANCE RAPID START FLUORESCENT LAMP SYSTEM

This is a continuation of application Ser. No. 002,043, filed Jan. 8, 1987, now abandoned.

The present invention relates to rapid start fluorescent lamp systems, and in particular, a rapid start fluorescent lamp system is provided having a modified impedance with interrupted cathode heating to provide energy savings.

Various efforts have been made in the prior art to provide rapid start fluorescent lamp systems, and energy conservation in fluorescent lamp systems, particularly the U.S. Pat. Nos. 4,435,670 and 4,501,992 by Evans et al, as well as the patent to Anderson, Jr. et al, Pat. No. 4,510,418. These prior art references involve techniques of using protective devices in energy saving, instant start, series sequence, fluorescent lamp systems having power reducing capacitors, as well as the use of a normally closed bimetal switch in a rapid start fluorescent lamp which eliminates failure at operating temperatures higher than room temperature.

The patent to Anderson, Jr. et al forms a bimetal switch with a heater or cathode electrode to discontinue heater current flow upon achieving conductivity of the lamp. In this arrangement, the bimetal switch is connected at an input to the heater electrode, and when conductivity is effected, the bimetal switch is opened and heater current flow is ended.

In Evans et al, a bimetal switch device is used in conjunction with a power reducing capacitor to eliminate failure of the ballast systems upon the failure to operate of a second lamp in a two lamp system such that damage of the system will occur by high current values.

The presently claimed invention provides a modified impedance rapid start fluorescent lamp system which can be utilized in any of several approaches in rapid start fluorescent lamp circuits.

The features of the present invention are achieved by the use of a circuit at one end of a lamp which achieves rapid starting, yet enables the operating current and ambient temperatures to be controlled at safe levels. This occurs by the presence of a normally closed thermal bimetal switch at each side of a cathode heater, together with a circuit in parallel with one of these bimetal switches. This circuit includes a parallel connection of a current limiting capacitor and a bleeder resistor, together with a third normally closed thermal bimetal switch. The third bimetal switch will open the lamp arc circuit if the operating current or ambient temperature exceeds levels considered to be unsafe.

Figure 1:
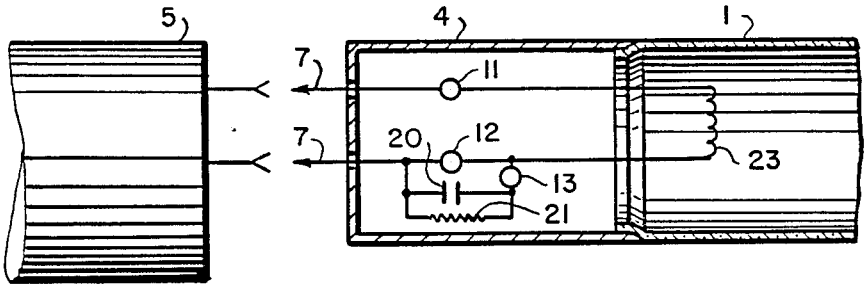
Figure 2:
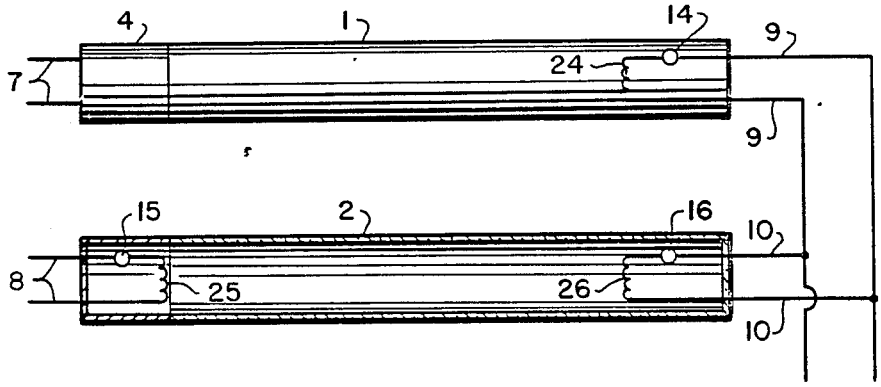
Figure 3A:
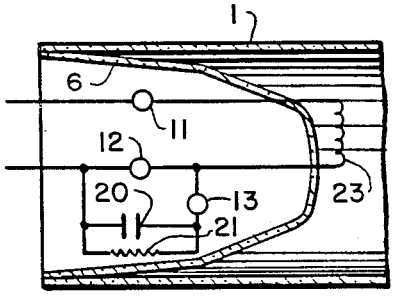
Figure 3B:
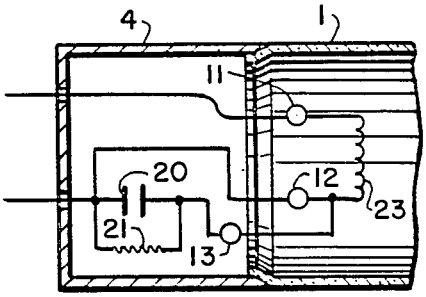
Figure 3C:
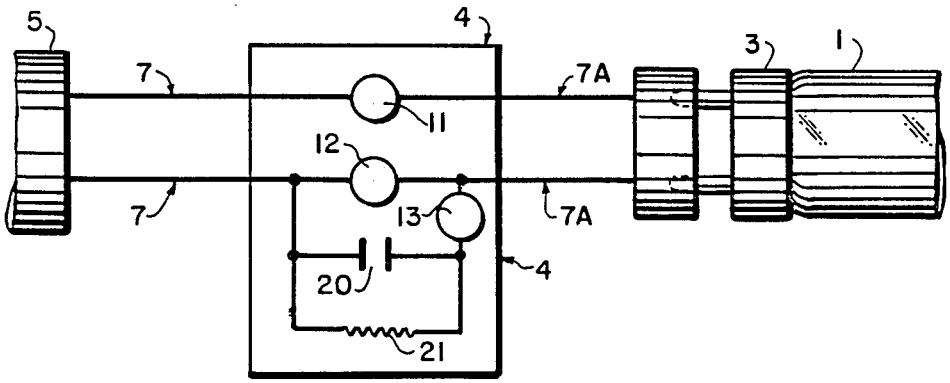

The structure and features of the present invention, together with other objects and improvements of the present invention, may be seen by reference to the drawing figures which show without limitation the features of the invention, and wherein FIG. 1 is a schematic illustration of the circuit according to the present invention;

FIG. 2 is a schematic illustration of the two lamp structure according to the present invention; and FIG. 3*a* is one variation of the arrangement of the present invention, FIG. 3*b* is another variation of this structure, and FIG. 3*c* is a still further variation.

Similar structural features in the present invention are identified in the drawing figures by the same reference numerals.

In FIG. 1 the concept of the present invention is illustrated by the arrangement of the cathode heater 23 with current flowing through the normally closed thermal bimetal switches 11 and 12 at opposite sides of the heater coil. The heater coil 23 is at one end of the lamp structure 1, and the bimetal switches 11 and 12 are contained in an enclosure 4 at this same end of the lamp. The circuitry of the present invention is included in the enclosure 4. The lamp 1 is connected to a ballast 5 by way of connectors 7.

According to the present invention, a circuit of a capacitor 20 connected in parallel to a resistor 21 is provided around bimetal switch 12. This parallel circuit of capacitor 20 and resistor 21 is connected in series with a third normally closed, thermal bimetal switch 13. The circuit of bimetal switch 13, capacitor 20, and resistor 21 is connected in parallel to one of the bimetal switches 11, 12 such as the bimetal switch 12.

Such a connection enables the lamp arc current to be continued to be supplied to the lamp through the current limiting capacitor 20 and the bleeder resistor 21 when the bimetal switches 11 and 12 are open. These bimetal switches 11 and 12 will ordinarily open shortly after the lamp has started in the rapid start mode.

This parallel circuit of the present invention will continue to pass current to the cathode 23. If the circuit or lamp exceeds safe operating currents or ambient temperatures, the bimetal switch 13 will open thereby opening the circuit of the cathode 23.

The energy saving features of this structure, illustrated in FIG. 1, includes the elimination of power consumed by one of the cathode heater circuits of the lamp by way of the bimetal switch 11 to achieve an approximately 0.5 watt savings in energy per two lamp rapid start ballast system. In addition, the bimetal switch 13, the capacitor 20 and the resistor 21 permit the lamp arc current to be reduced as it passes through the capacitor 20 after a predetermined time interval that allows adequate cathode heating during the starting of the lamp. The capacitor 20 may have a value of 2 microfarad so that the power reduction for the system is approximately 50% or about 45 watts. An approximately 50% reduction in light output also occurs, but by appropriate choice of the capacitor value, other power reductions may be achieved.

FIG. 2 illustrates a further arrangement of the circuitry according to the present invention in which a two lamp system is provided. In this arrangement, in addition to the circuitry provided in FIG. 1 above, the lamp 1 also has a second cathode heater 24 at the opposite end with another bimetal switch 14 at one side of this cathode heater. This bimetal switch 14 performs the same function as bimetal switch 11. Accordingly, an additional power savings of approximately 0.5 watts is achieved. In this two lamp system, the second lamp 2 may include additional thermal bimetal switches 15 and 16 located in each cathode circuit 25 and 26. These additional bimetal switches provide further energy savings since this will cut out 3.5 volts by heat of the cathode, but a 100 volt potential will exist across tube 2 between cathode circuits 25 and 26. Also tube 2 does not need cathode cut outs.

In a variation of the structure illustrated in FIG. 1, a lamp flare 6 is provided around the bimetal switch circuitry 11 and 12 of the cathode 23, as well as the parallel circuit 20, 21 and bimetal switch 13. The cathode 23 extends into the lamp 1, as may be seen in FIG. 3*a*.

In another modification, FIG. 3*b* illustrates the arrangement of the bimetal switches 11 and 12 within the lamp structure 1 adjacent to the cathode 23, while the parallel circuit of capacitor 20, resistor 21 and third bimetal switch 13 are placed in the enclosure 4 of the lamp 1. This arrangement of FIG. 3*b* also provides the bimetal switch 13 in series with the parallel arrangement of the resistor 21 and capacitor 20.

FIG. 3*c* represents a further variation in which the enclosure 4 is provided as a separate structure to be located between the lamp 1 and the ballast 5. The separate enclosure contains the circuitry of the present invention including the two bimetal switches 11 and 12, as well as the parallel connection of the capacitor 20 and resistor 21 in series with the bimetal switch 13. This separate structure is connected to a standard lamp 1 by way of the connectors 7A attached to the end 3 of the lamp.

The advantages of the modified impedance design of the present invention over existing non-cathode heating circuits, as well as existing modified impedance lamps, are that the energy savings for the combined features are additive according to the present invention. Moreover, lamp weight and installation are simplified by the elimination of isolation transformers, as required in prior art modified impedance lamps.

The bimetal switches 11, 12 and 14 can be selected such that the reclose times ensure in the case of momentary power failure, or in the case when the lamp system is turned off and on rapidly, that lamps 1 and 2 in FIG. 2, for example, do not instantly start when the power is turned on again. The lamp system would not start because cathode heating is not available for cathode coils 23 and 24 of lamp 1 by the open switches 12 and 14. But when bimetal switches 12 and 14 reclose, the system would start cathode heating at both cathode coils 23 and 24.

What we claim:

1. A rapid start fluorescent lamp system comprising at one end of a lamp a normally closed thermal bimetal switch at each side of a cathode, and a circuit connected in parallel with one said bimetal switch, said circuit including a parallel connection of a current limiting capacitor and a bleeder resistor, and a third normally closed thermal bimetal switch connected in series with the parallel connection of said current limiting capacitor and said bleeder resistor.

2. A rapid start fluorescent lamp system according to claim 1, wherein a fourth thermal bimetal switch is connected in series with another cathode at a second end of said lamp.

3. A rapid start fluorescent lamp system according to claim 1 or claim 2, further comprising at least one second lamp connected in series with said first lamp, wherein said second lamp has a cathode at each end with each said cathode having a series connected thermal bimetal switch.

4. A rapid start fluorescent lamp system according to claim 3, wherein said bimetal switch at each side of said cathode and said circuit are provided in an enclosure at said one end of said lamp.

5. A rapid start fluorescent lamp system according to claim 3, wherein said bimetal switch at each side of said cathode and said circuit are included in a lamp flare at said one end of said lamp.

6. A rapid start fluorescent lamp system according to claim 3, wherein said circuit is included in an enclosure at said one end of said lamp, and said thermal bimetal switches at each side of said cathode are included in said lamp.

7. A rapid start fluorescent lamp system according to claim 1 or claim 2, wherein said bimetal switch at each side of said cathode and said circuit are provided in an enclosure at said one end of said lamp.

8. A rapid start fluorescent lamp system according to claim 1 or claim 2, wherein said bimetal switch at each side of said cathode and said circuit are included in a lamp flare at said one end of said lamp.

9. A rapid start fluorescent lamp system according to claim 1 or claim 2, wherein said circuit is included in an enclosure at said one end of said lamp, and said thermal bimetal switches at each side of said cathode are included in said lamp.

10. A rapid start fluorescent lamp system according to claim 1 or claim 2, wherein said bimetal switches and said circuit are provided in a separate enclosure, said separate enclosure being separately connected to an end of said lamp.

* * * * *